United States Patent [19]

LaGrange et al.

[11] Patent Number: 4,787,817

[45] Date of Patent: Nov. 29, 1988

[54] DEVICE FOR MONITORING CLEARANCE BETWEEN ROTOR BLADES AND A HOUSING

[75] Inventors: Jean-Paul LaGrange, Le Chatelet en Brie; Jean-Max M. Silhouette, Melun, both of France

[73] Assignee: Societe Nationale d'Etude et de Construction de Moteurs d-Aviation (SNECMA), Paris, France

[21] Appl. No.: 829,006

[22] Filed: Feb. 13, 1986

[30] Foreign Application Priority Data

Feb. 13, 1985 [FR] France ..... 85 02022

[51] Int. Cl.[4] ..... F01D 11/08

[52] U.S. Cl. ..... 415/174; 415/138; 415/177

[58] Field of Search ..... 415/134, 135, 136, 137, 415/138, 172, 173, 174, 177

[56] References Cited

U.S. PATENT DOCUMENTS

| | | | |
|---|---|---|---|
| 12,317 | 2/1905 | Fullagar | 415/173 |
| 1,223,914 | 4/1917 | Wiberg | 415/135 |
| 2,247,387 | 7/1941 | Johnson et al. | 415/126 |
| 2,247,423 | 7/1941 | Webster, Jr. | 415/126 |
| 3,425,665 | 2/1969 | Lingwood | 415/134 |
| 3,532,437 | 10/1970 | Strub | 415/136 |
| 3,860,358 | 1/1975 | Cavicchi et al. | 415/134 |
| 3,892,497 | 7/1975 | Gunderlock et al. | 415/138 |
| 3,985,465 | 10/1976 | Sheldon et al. | 415/201 |
| 4,131,388 | 12/1978 | Brodell | 415/138 |
| 4,522,559 | 6/1985 | Burge et al. | 415/138 |
| 4,565,492 | 1/1986 | Bart et al. | 415/138 |
| 4,642,027 | 2/1987 | Popp | 415/177 |

FOREIGN PATENT DOCUMENTS

| | | | |
|---|---|---|---|
| 76744 | 6/1919 | Austria | 415/136 |
| 500965 | 3/1954 | Canada | 415/138 |
| 846342 | 6/1952 | Fed. Rep. of Germany | 415/139 |
| 1116685 | 5/1962 | Fed. Rep. of Germany . | |
| 1062311 | 4/1954 | France . | |
| 2228967 | 12/1974 | France . | |
| 2293594 | 7/1976 | France . | |
| 2450344 | 2/1980 | France . | |
| 2485633 | 6/1981 | France . | |
| 2540560 | 2/1983 | France . | |
| 408960 | 9/1966 | Switzerland . | |
| 689270 | 3/1953 | United Kingdom | 415/139 |
| 1484288 | 9/1977 | United Kingdom . | |
| 2047354 | 11/1980 | United Kingdom . | |
| 2063374 | 6/1981 | United Kingdom . | |
| 2087979 | 6/1982 | United Kingdom . | |

*Primary Examiner*—Robert E. Garrett
*Assistant Examiner*—John T. Kwon
*Attorney, Agent, or Firm*—Bacon & Thomas

[57] ABSTRACT

A device for maintaining clearance between rotor blades and a surrounding housing is disclosed in which the device radially expands or contracts to match the expansion or contraction of the rotor blade tips. The expansion or contraction of the device is achieved by thermal transfer between the device and the gasses passing over the rotor blades. The device has several alternating segments having different thermal characteristics such that the expansion/contraction characteristics of the rotor blade can be accurately matched by the device.

11 Claims, 4 Drawing Sheets

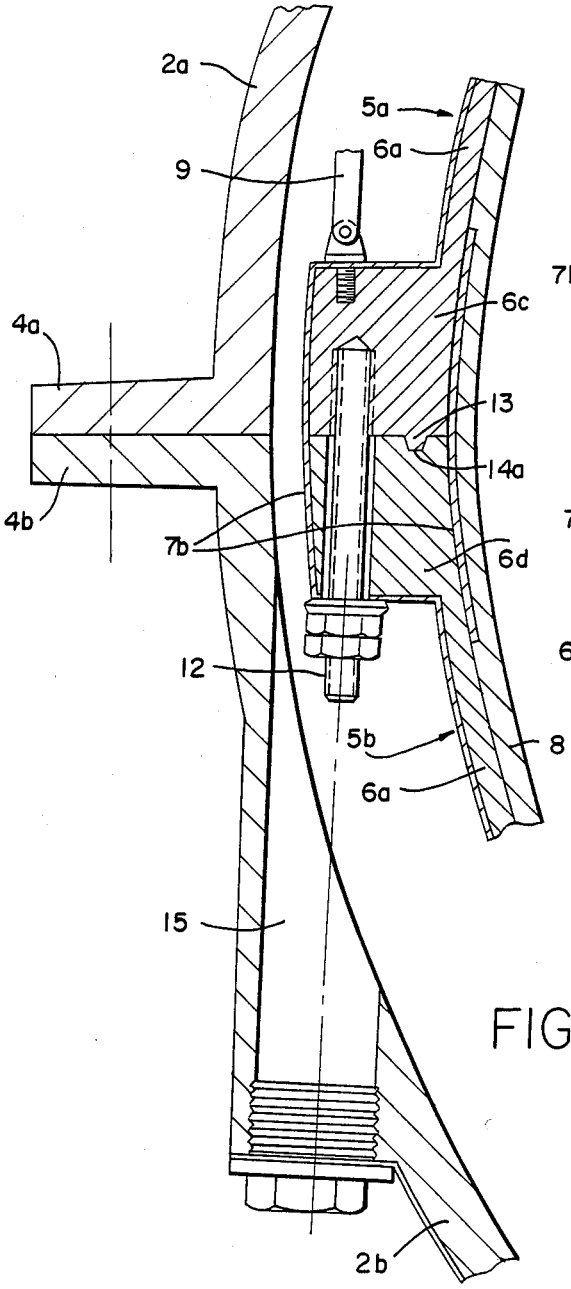
FIG. 3
FIG. 3a
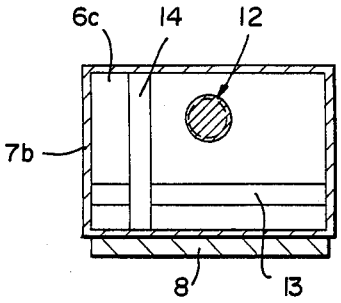
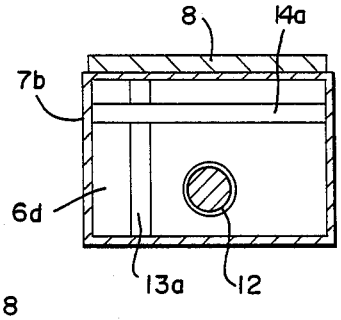
FIG. 3b

DEVICE FOR MONITORING CLEARANCE BETWEEN ROTOR BLADES AND A HOUSING

FIELD OF THE INVENTION

The present invention relates to a device for maintaining clearance between the tips of compressor or turbine blades and a surrounding housing in a turbojet engine.

BRIEF DESCRIPTION OF THE PRIOR ART

In a turbojet engine, it is, of course, necessary to maintain clearance between the tips of the compressor and turbine rotor blades and the surrounding housing. Contact between the housing and one or more of the rotor blade tips would certainly result in severe damage to the rotor blade and/or housing and could quite possibly cause catastrophic failure of the turbojet engine.

The clearance between the housing and the rotor blade tips should be maintained at a minimum distance, however, in order to maximize the gas stream flow over the working surfaces of the rotor blades. The difficulty of maintaining such a clearance is compounded due to the radial expansion or contraction of the rotor blade tips as the operating parameters of the turbojet engine varies. The rotor blades and rotor wheel are subjected to a gaseous stream, which may have a very high temperature so as to induce thermal expansion in both the blade and the rotor wheel. Also, as the rotor speed increased, centrifugal force will also tend to increase the outer diameter of the rotor blades.

One solution to this problem has been to maintain the clearance between the housing and the rotor blade tips at an unusually large dimension to accommodate for the radial expansion of the rotor blades. However, as noted above, this deleteriously effects the engine performance and reduces the engine's efficiency.

Other solutions involve the use of an inner, annular wall attached within the housing and surrounding the rotor blades, the inner, annular wall incorporating means to cause its radial expansion or contraction as the engine operating parameters change. However, these solutions typically involve directing a portion of the gaseous stream passing over the rotor blade wheel into the annular wall to cause its expansion or contraction. This also reduces the efficiency of the engine. Such systems are shown in French Pat. Nos. 2,540,560; 2,485,633; 2,450,344; British Pat. Nos. 2,047,354; and 2,063,374. Not only do such devices reduce the overall efficiency of the engine, they are bulky, heavy and complex, therefore inherently reducing their reliability.

SUMMARY OF THE INVENTION

The present invention avoids the drawbacks of the prior art systems, while providing the requisite clearance throughout all of the engine's operational range. The device comprises an inner, annular wall attached to the outer housing and surrounding the rotor blade tips and spaced apart therefrom a predetermined, minimum distance. The annular wall is composed of first and second segments interconnected together, such that the annular wall is a rigid structure surrounding the rotor wheel. The first segments have a relatively small radial dimension and a relatively low thermal inertia, and are in contact with the gaseous stream passing over the working surfaces of the rotor blades. The second segments have a relatively larger radial dimension and a relatively higher thermal inertia than the first segments.

Attachment means are provided to attach the annular wall to the outer housing such that the annular wall may undergo radial expansion or contraction.

The peripheral expansion of the first segments, caused by an increase in temperature of the working gasses, results in a radial expansion of the annular wall, since all of the segments are rigidly attached together. The attachment means includes an attachment rod effectively connected to the annular wall in a tangential direction, so as to provide no interference with the radial movement of the annular wall.

BRIEF DESCRIPTION OF THE DRAWINGS

FIG. 3 is an enlarged, sectional view of area III in FIG. 1.

FIGS. 3*a* and 3*b* show details of the contact surfaces of the segment shown in FIG. 3.

DETAILED DESCRIPTION OF THE PREFERRED EMBODIMENTS

Figure 1:
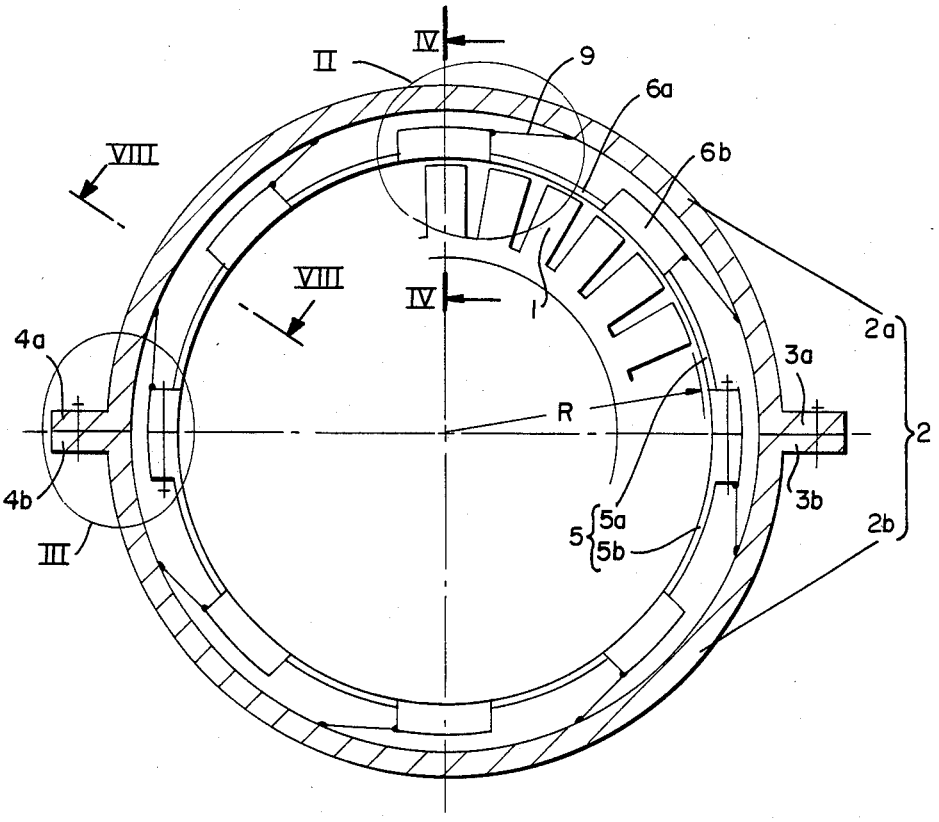
FIG. 1 is a cross-sectional view showing a turbojet engine incorporating the device according to the invention.

The operating radius R of the tips of rotor blades 1 at any given instant is a function of the temperature (T) of the gasses passing over the rotor blades and the angular speed (N) of the rotor wheel, to which the rotor blades are attached. The elevated temperature of hot gasses passing over the rotor blades 1 generates a heat flow which passes through the blades into the rotor wheel, and thereby causes radial expansion of this assembly. Such an expansion causes an increase in the radius of rotation R for a steady state temperature. Where the angular speed of the rotor blades is 0 (N=0), the radius of rotation R of the blade tips can be defined as follows:

$$R=R_0+K_1(T-T_0).$$

Where:

$R_0$=radius of rotation of the blade tips at $T_0$, ambient temperature at ground level; $K_1$=thermal radial expansion coefficient of the rotor wheel.

When the temperature (T) varies, the radial shifting of the blade tips obeys a rather complex law, since the rotor blades themselves are directly in contact with the hot gasses and are relatively thin, and therefore heat or cool rapidly, whereas the rotor wheel itself, which is substantially thicker and more remote from the hot gasses, heats or cools more slowly.

Thus, if it is assumed that the temperature T of the engine gasses progresses from a first stable temperature $T_1$ to a new stable temperature $T_2$ (again with the rotor speed N assumed to be 0), the corresponding change in the radius of rotation from $R_1$ to $R_2$ of the rotor blade tip subjected to this change in temperature takes place as follows: initially, the change is relatively rapid with approximately 50% of the total shift taking place in 5 to 10 seconds, then the change slows, with the remaining 50% shift taking place in approximately 10–20 minutes. This behavior can be described as a function of the time t as follows:

$$R = R_1 + K'_1 \cdot (T_2 - T_1) \cdot \left(1 - e^{\frac{-t}{\theta'}}\right) + K''_1 \cdot (T_2 - T_1) \cdot \left(1 - e^{\frac{-t}{\theta''}}\right)$$

where:

$K'_1$ = thermal radial expansion coefficient of the moving blades;

$K''_1$ = thermal radial expansion coefficient of the disk;

$\theta'$ = time-constant of the thermal radial expansion of the moving blades;

$\theta''$ = time-constant of the thermal radial expansion of the disk and where:

$K'_1 + K''_1 = K_1$ $K'_1$, $K''_1$ are about 0.50

$\theta'$ is about 5 seconds, $\theta''$ is about 10 minutes.

These four parameters can be computed to determine a system response to any change in the gas temperature T.

The angular speed N of the rotor blade wheel produces a centrifugal force acting on the rotor assembly which generates another component to vary the radial dimension R of the rotor blade tips. For a steady state speed, and assuming the gas flow temperature to be equal to the ambient temperature $T_0$, the radius of rotation R of the blade tips can be defined by $$R = R_0 + K_2 N^2$$

wherein $K_2$ = centrifugal radial expansion coefficient of the rotor.

The above equation is valid when the speed N changes, while the temperature T of the gas flow is constant at $T_0$. The centrifugal force does not effect the angular speed N of the rotor and the time T only applies through the change in speed N.

Under typical operating conditions, however, the speed N and the temperature T will both be varying and their effects on the radius of rotation R will be additive. In the steady state (N and T constant), the function can be expressed by:

$$R = R_0 + K_1(T - T_0) + K_2 N^2$$

However, the temperature T of the hot gas flow at a particular point in the gas stream is a function of the angular speed N of the rotor wheel:

$$T = T_0 + K_3 N^2$$

wherein: $K_3$ = proportionality constant for T and $N^2$.

This relationship can also be written as:

$$N_2 = (T - T_0)/K_3$$

Accordingly, the radius of rotation R of the rotor blades 1 is related to the temperature of the gaseous fluid flow at a particular point in the gas stream by a simultaneous function:

$$R = R_0 + (K_1 + K_2/K_3)(T - T_0)$$

In the transient state, with both N and T varying, the portion of the turbojet engine which is being considered (i.e. whether the rotor wheel is a compressor or a turbine) becomes a factor. If the rotor wheel is a compressor, which is typically located upstream of the combustion chambers of the engine, the temperature T of the gas flow is virtually in step with the rotor speed N, such that the above relation $T = T_0 + K_3 N^2$ still applies, and the centrifugal effect can be stated as follows:

$$R = R_0 + (K_2/K_3)(T - T_0)$$

This effect is additive, as in the aforementioned steady-state case, to that for the temperature T of the gaseous fluid.

If the rotor wheel is a turbine, which is located downstream of the combustion chamber, the change in temperature T is effected by the variation in N due to an instantaneous excess or deficiency of the fuel burned in the combustion chamber with respect to the fuel required for steady state operation. The following relationship now applies:

$$T = T_0 + K_3 N^2 + \Delta T_C = T_N + \Delta T_C$$

Wherein:

$\Delta T_C$ = temperature deviation due to the excess or deficiency of burnt fuel;

$T_N$ = temperature of the turbine gases if speed N is steady.

Therefore, the centrifugal effect takes the form:

$$R = R_0 + (K_2/K_3)(T_N - T_0) = R_0 + (K_2/K_3)(T - \Delta T_0).$$

This effect, therefore, is not proportional to $T - T_0$, but is proportional to $(T_N - T_0)$.

The temperature deviation $\Delta T_C$ directly effects the radius of rotation R due to the temperature T as in the aforementioned case. However, its duration, at most, equals that of the transition of the speed N (i.e. 5 to 10 seconds) for a simple change of speed. Therefore, its effect makes itself felt only on the expansion of the rotating blades 1, that is in the case of a temperature step change as described above, related only to the gain $K'_1$ and the time constant $\theta'$.

FIG. 1 shows a partial, cross-sectional schematic view of a turbojet engine incorporating the device according to the invention. A stationary housing 2 surrounds the rotor blades 1. Housing 2 may be fabricated in two parts 2*a* and 2*b*, each having a semi-cylindrical shape. Each portion 2*a* and 2*b* includes respective brackets 3*a*, 4*a* and 3*b*, 4*b* which may be assembled and retained in such assembled relationship in any known manner.

Figure 2:
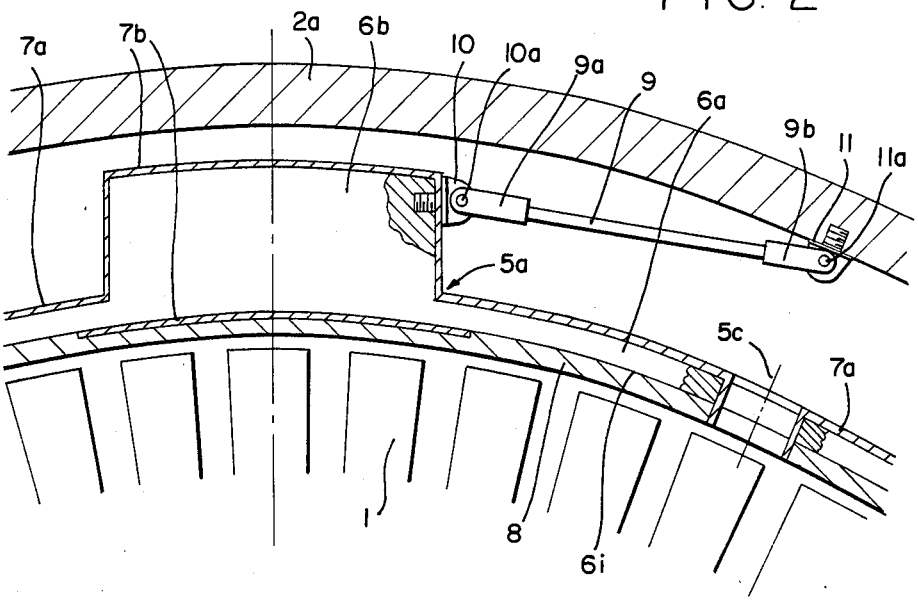
FIG. 2 is an enlarged, sectional view of the area II in FIG. 1.

The housing 2 has a rigid, annular wall 5 mounted therein between the housing 2 and the tips of the rotor blades 1. The rigid, inner annular wall 5 may also be fabricated in two semi-cylindrical portions, 5*a* and 5*b*. Annular wall 5 comprises a plurality of segments 6 solidly joined to each other. Segments 6*a* have a relatively small radial dimension, as shown in FIG. 2, and each such segment has its inner surface 6*i* in direct contact with the gas flow stream passing over the working surfaces of rotor blades 1. The remaining exposed surfaces of each segment 6*a* is covered with a thermally insulating layer 7*a*. Due to the small radial dimension, each of the segments 6*a* rapidly assumes the temperature of the gasses flowing over the rotor blades.

Each adjacent segment 6*b* has a relatively larger radial dimension, and has all of its exposed surfaces covered by a coating 7*b* of a thermally insulating material. Accordingly, segments 6*b* have a relatively high thermal inertia and their thermal connection to the gas flow stream takes place virtually solely through their junctions with adjacent segments 6*a*. Therefore, segments 6*b* only very slowly assume the temperature of the gasses passing over the rotor blades. Insulating layers 7*a* and 7*b* are formed of a material having sufficient flexibility to follow any thermal expansion/contraction of the inside wall segment without damage.

Although the specific number of segments 6*a* and 6*b* will, of course, depend upon the diameter of the rotor blade wheel, a sufficient number of segments should be utilized to preserve the circular shape of the wall during the thermal expansions or contractions.

The inside surface of the annular wall 5 can be covered with a coating 8 made of an abradable material which, in known fashion, forms a sealing and wear lining which may make contact with the rotor blade tips without causing damage to the engine structure. The abradable material 8 may cover the inner surfaces of both segments 6*a* and 6*b*. This material is selected such that no thermal barrier is interposed between the inner surface 6*i* of the segments 6*a* and the gas flow stream such that the thermal expansion or contraction of the annular wall 5 is not effected.

Attaching means are also incorporated to attach the annular wall 5 to the inside of housing 2. An attachment rod 9 extends substantially tangentially to the annular wall 5 and has a first end 9*a* pivotally attached to a segment 6*b* via a pivoting mechanism comprising a fork joint 10 and a pivot pin 10*a*. The opposite end 9*b* is attached to housing 2 via fork joint 11 and pivot pin 11*a*. Ends 9*a* and 9*b* may be in the form of yokes which pivot about the pins 10*a* and 11*a*. Due to their substantial tangential orientation, the attachment rods do not interfere with the radial expansion or contraction of the annular wall 5. An access opening 5*c* may be provided in one or more of the segments 6*a* to facilitate the attachment of the rod 9 to the housing 2.

The semi-cylindrical portions 5*a* and 5*b* of the annular wall 5 are assembled such that they bear against each other and their longitudinal axis remains coincident with the longitudinal axis of the turbojet engine during the thermal expansion or contraction. Each of the ends of the sections 5*a* and 5*b* includes a relatively thick half-segment 6*c* or 6*d*, as shown-in detail in FIGS. 3, 3*a* and 3*b*. The half-segments 6*c* and 6*d* may be fastened together by means of bolt 12. The mating surfaces of the half segments of 6*c* and 6*d* also define a tenon 13 and a mortise 14, extending in perpendicular directions which respectively cooperate with mortise 14*a* and tenon 13*a* of the associated half-segment surface. The interengaging mortise and tenon joint serve to accurately and solidly join the portions 5*a* and 5*b* together. An access hole 15 may be provided through the housing 2 to facilitate installation of bolt 12.

Figure 4:
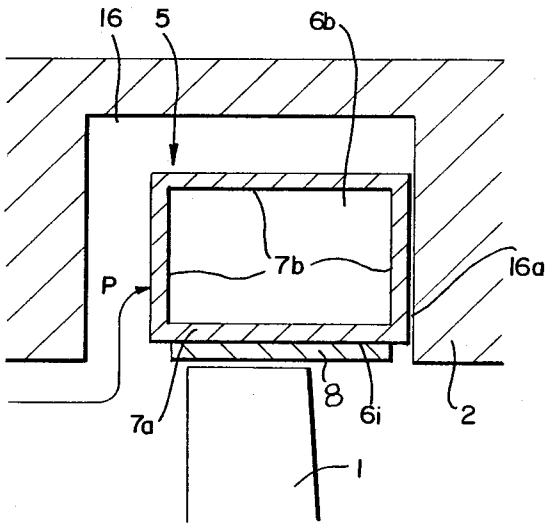
FIG. 4 is a partial, longitudinal sectional view taken along line IV—IV in FIG. 1.

As shown in FIG. 4, annular wall 5 may be disposed in an annular access 16 defined by housing 2. Due to the gas pressure P, annular wall 5 is laterally pressed against downstream surface 16*a* of the recess. The corresponding side surface of annular wall 5 is covered with a thermally insulating layer 7*b*, as previously indicated, which, in this area, prevents gas leaks, reduces contact friction and lowers the heat transfer between the annular wall 5 and the housing 2. In the structure shown in FIG. 4, the rotor blade 1 is a turbine blade wherein the upstream pressure forces annular wall 5 against downstream surface 16*a* of the recess 16. If rotor blade 1 were a compressor blade stage, the annular wall 5 would be laterally pressed against the upstream surface of recess 16. In the examples shown, both the annular wall 5 and the housing 2 have a generally cylindrical shape corresponding to the outer contour of the gas stream within the zone being considered. Obviously, the invention may be applied in the same way where the annular wall 5 and the inner portion of housing 2 have a generally conical shape.

The annular wall 5, through the use of segments 6*a* and 6*b* having differing thermal characteristics, forms a "thermal model" of the rotor blade on the inside of the housing 2. The radial expansion or contraction of the annular wall 5 is made such that, in both the transient and steady state modes of operation, it accurately follows the radial expansion or contraction of the rotor blade 1 solely by the thermal effects of the gaseous fluid impinging on the inner surface of the wall 5. Since the annular wall 5 forms a rigid ring, any peripheral expansion is, of necessity, converted into radial expansion of the annular wall.

The thermal coefficient of expansion and the total peripheral length of the low thermal inertia segment 6*a* are selected such that the thermal expansion of these segments impart to the annular wall 5 a radial expansion equal to the displacement of the rotor blade tips due to their own thermal expansion and to the centrifugal force for the steady state The heat capacity of the segment material, the radial thickness of the segment and the heat-transfer coefficients of the thermal coating are selected such that segments 6*a* have a thermal time-constant matching that of the rotor blades 1 alone ($\theta'$).

Similarly, the thermal expansion coefficient and the total peripheral length of the high thermal inertia segments 6*b* are selected such that their thermal elongation impart to the annular wall 5 a radial expansion equal to that of the rotor blade tips due to the thermal expansion of the rotor wheel (coefficient $K''_1$). The specific heat of the material, the mass, the shape, the cross-section of the junctions of the segments 6*a* and 6*b*, and the heat transfer coefficients of the thermal coating 7*b*, are selected such that segments 6*b* have a thermal time-constant equal to that of the rotor wheel alone ($\theta''$).

Figure 5:
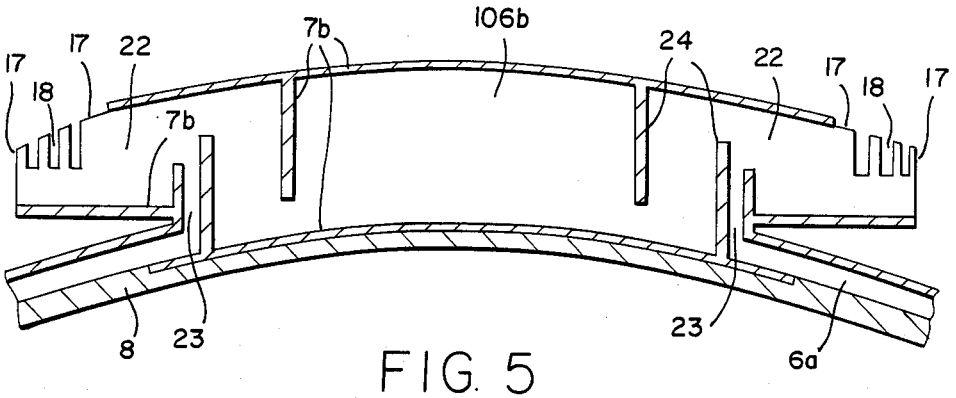
FIG. 5 is a partial, schematic representation of a second embodiment of the device according to the invention.

FIG. 5 discloses a structural variation in the second segment, 106*b*. In this construction, strips 23 between the adjacent segments 6*a* and internal partitions 24 retard the admittance and flow of heat into the segment 106*b*. Segment 106*b* also has peripheral extensions 22 extending therefrom, which extensions define heat radiation zones 17 which may have cooling fins 18 to radiate heat toward housing 2 and thereby decrease the temperature of the segments 106*b*. Spacers having a very low or 0 thermal coefficient of expansion may be placed in the middle of segment 6*b*. Such allows the characteristics of the annular wall 5 to be adjusted so as to precisely match those of the rotor blades 1.

Figure 6:
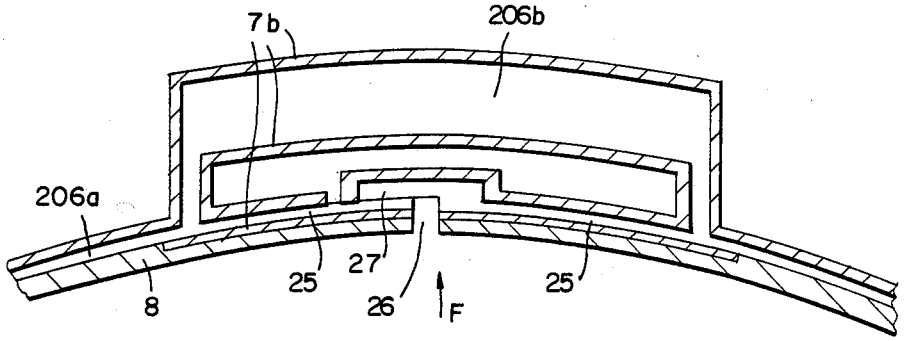
FIG. 6 is a partial, schematic representation of a third embodiment of the device according to the invention.
Figure 6A:
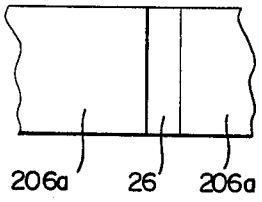
FIGS. 6*a*, 6*b* and 6*c* show three variations of the device in FIG. 6 viewed in the direction of arrow F in FIG. 6.
Figure 6B:
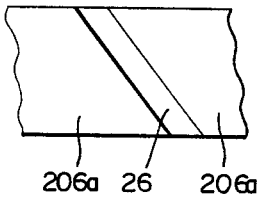
Figure 6C:
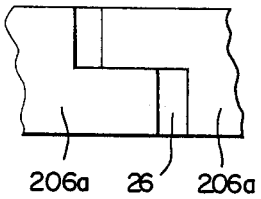

FIG. 6 shows another alternative for the high thermal inertia segments 206*b*. In this embodiment, inertia segments 206*b* are arranged on the outside of adjacent low thermal inertia segments 206*a*. Portions 25 extend from segments 206*a* toward each other, and are separated by a gap 26 which may assume various orientations as shown in FIGS. 6*a*, 6*b* and 6*c*. Gap 26 may be straight, slanted or tapered. The ends of portions 25 are overlapped by a portion 27 which serves to cover the gap between the adjacent segments.

In the situation where the rotor blade is a turbine in the transient state, the instantaneous excess or shortage of burnt fuel must be accounted for, which is instantaneously rendered by a higher or lower temperature T than the steady state N. Therefore, the clearance between the rotor blade tips and the annular wall 5 increases or decreases instantaneously. Acceleration remains substantially unaffected, but a somewhat larger clearance is required than in the steady state condition, such that it remains adequate during engine deceleration.

Figure 7:
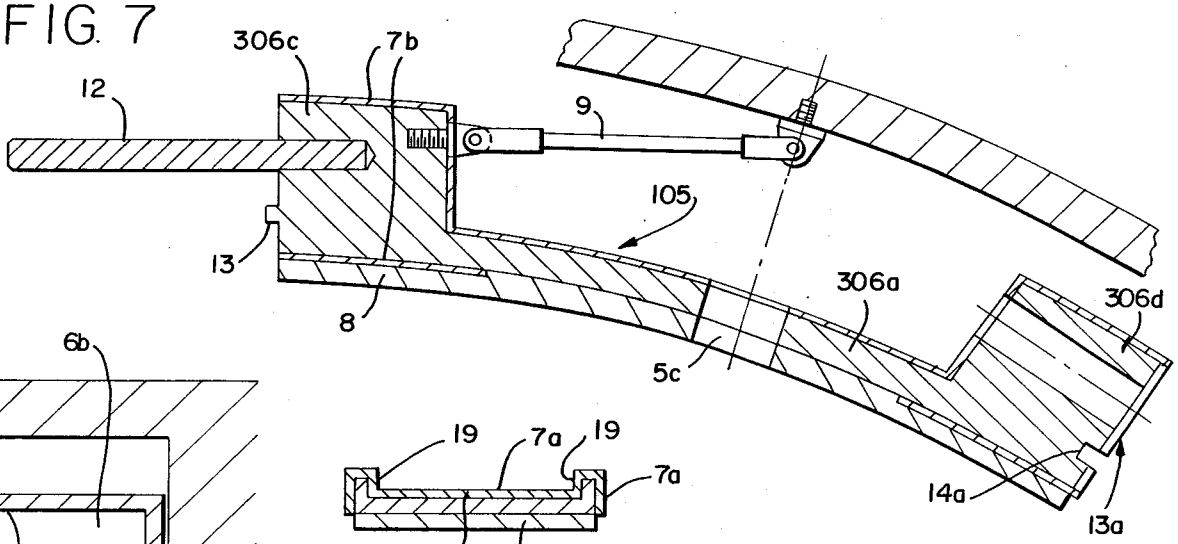
FIG. 7 is a partial, sectional view showing a fourth embodiment of the device according to the invention.

To facilitate the manufacture and the repair of the annular wall 5, it is convenient to form the annular wall from a plurality of elements shown in FIG. 7. Each of the elements 105 which form the annular wall 5 ends with two half-segments 306*c* and 306*d* having high thermal inertia. Each of these half-segments have means to fasten it to an adjacent segment. There may be as many elements 105 as there are low thermal inertia segments 306*a*. The half-segments may be affixed to each other by means previously described and shown in FIGS. 3, 3*a* and 3*b*.

Figure 8A:
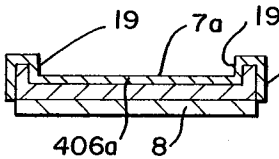
FIGS. 8*a* and 8*b* are partial, longitudinal cross-sections showing variations in the cross-section of the device according to the invention.
Figure 8B:
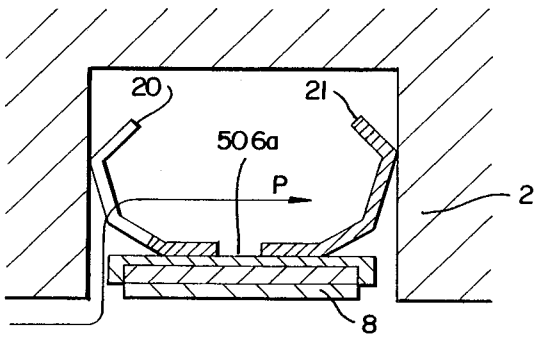

Due to the relatively small radial dimension of the low thermal inertia segments, the strength of the annular wall 5 may be inadequate even though it may bear against a surface of recess 16 as shown in FIG. 4. As illustrated in FIG. 8*a*, stiffening ribs 19 may be formed on the outer surface of low thermal inertia segments 406*a* near the upstream and downstream edges. Alternatively, as shown in FIG. 8*b*, each side edge of low thermal inertia segment 506*a* may be provided with offset stiffeners 20 and 21 affixed to the outer surface of the segment.

The foregoing description is provided for illustrative purposes only and should not be construed as in any way limiting this invention, the scope of which is defined solely by the appended claims.

What is claimed is:

1. In a turbojet engine having a housing and at least one rotor blade wheel rotatable with respect to the housing and having a plurality of rotor blades radially extending from its periphery, the improved device for maintaining a clearance around the rotor blade tips as they undergo centrifugal and thermal expansion and contraction, comprising:

(a) continuous inner annular wall having thermal characteristics substantially the same as the rotor blade wheel and rotor blades, and disposed about the rotor wheel at a predetermined minimum distance from the tips of the rotor blades, the annular wall comprising:

(i) a plurality of first segments having a relatively thin radial dimension and a relatively low thermal inertia, and inner wall of each of the first segments being exposed to the gas passing across rotor blades; and, (ii) a plurality of second segments, each second segment interposed between and rigidly affixed to adjacent first segments such that peripheral expansion of contraction of the first and second segments causes radial expansion of contraction of the continuous inner annular wall to maintain the predetermined distance from the rotor blade tips, the second segments having a larger radial dimention and a higher thermal inertia than the first segments; and (b) attaching means to attach at least some of the second segments to the housing so as to permit the annular wall to radially expand to contract with respect to the housing.

2. The improved device according to claim 1 further comprising a thermally insulating material covering outer and lateral surface of the first segments, and a thermally insulating material covering all surfaces of the second segments.

3. The improved device according to claim 1 wherein the attaching means comprises:

(a) an attachment rod extending substantially tangentially to the inner annular wall;

(b) first pivot means pivotally attaching a first end of the attachment rod to a second segment; and, (c) second pivot means pivotally attaching a second end of the attachment rod to the housing.

4. The improved device according to claim 1 wherein the inner annular wall is divided into two semi-cylindrical portions along a plane extending through opposite second segments and further comprising:

(a) fastening means to attach the second segments of one semi-cylindrical portion to corresponding second segments of the other semi-cylindrical portion; and, (b) alignment means formed on the second segments to properly align the semi-cylindrical portions.

5. The improved device according to claim 4 wherein the alignment means comprises inter-engaging mortise and tenon formed on the second segments.

6. The improved device according to claim 1 wherein the housing defines a recess extending about the rotor blades, the recess having upstream and downstream surfaces such that the annular wall and attaching means are disposed in the recess such that a lateral side of the annular wall contacts one of the upstream or downstream surfaces and further comprising a thermal insulating layer attached to at least the lateral surface of the annular wall contacting the upstream or downstream surface.

7. The improved device according to claim 1 further comprising a layer of abradable material disposed on inner surfaces of the first and second segments to act as a seal and wear liner for the rotor blades.

8. The improved device according to claim 1 further comprising stiffening ribs extending radially outwardly from the first segments.

9. The improved device according to claim 1 wherein the second segments further comprise:

(a) a plurality of internal partitions extending into the interior of the second segments;

(b) peripheral extensions extending from the second segments, the peripheral exteriors defining heat transfer fins; and, (c) a thermally insulating coating covering all external surfaces of the second segments, except for the heat transfer fins.

10. The improved device according to claim 1 wherein adjacent first segments define a longitudinal gap therebetween and the second segments are located radially outwardly of the first segments and extend across the longitudinal gap.

11. The improved device according to claim 1 wherein at least one first segment defines an access hole therethrough to facilitate access to the attaching means.

* * * * *

UNITED STATES PATENT AND TRADEMARK OFFICE

CERTIFICATE OF CORRECTION

PATENT NO. : 4,787,817

DATED : November 29, 1988

INVENTOR(S) : LaGRANGE ET AL

It is certified that error appears in the above-identified patent and that said Letters Patent is hereby corrected as shown below:

Col. 4, line 42, the end of the equation should read --$(T - \Delta T_C - T_O)$--.

Col. 6, line 2, "access" should be --recess--.

Col. 8, line 13 of Claim 1, "to" (second occurrence) should be --or--.

Signed and Sealed this

Eighteenth Day of April, 1989

*Attest:*

*Attesting Officer*

DONALD J. QUIGG

*Commissioner of Patents and Trademarks*